US010087711B2

(12) United States Patent
Sargent et al.

(10) Patent No.: US 10,087,711 B2
(45) Date of Patent: Oct. 2, 2018

(54) FRACKING VALVE AND METHOD FOR SELECTIVELY ISOLATING A SUBTERRANEAN FORMATION

(71) Applicant: Steelhaus Technologies Inc., Calgary (CA)

(72) Inventors: Shane Sargent, Calgary (CA); Matthew McCarthy, Calgary (CA)

(73) Assignee: Torsch Inc., Calgary (CA)

( * ) Notice: Subject to any disclaimer, the term of this patent is extended or adjusted under 35 U.S.C. 154(b) by 23 days.

(21) Appl. No.: 15/512,432

(22) PCT Filed: Oct. 1, 2015

(86) PCT No.: PCT/CA2015/050991
§ 371 (c)(1),
(2) Date: Mar. 17, 2017

(87) PCT Pub. No.: WO2016/049771
PCT Pub. Date: Apr. 7, 2016

(65) Prior Publication Data

US 2017/0275967 A1 Sep. 28, 2017

Related U.S. Application Data

(60) Provisional application No. 62/058,477, filed on Oct. 1, 2014.

(51) Int. Cl.
*E21B 34/10* (2006.01)
*E21B 34/14* (2006.01)
(Continued)

(52) U.S. Cl.
CPC ..... *E21B 34/10* (2013.01); *E21B 34/14* (2013.01); *E21B 43/26* (2013.01); *E21B 2034/007* (2013.01)

(58) Field of Classification Search
CPC ..... E21B 34/10; E21B 34/14; E21B 34/007; E21B 43/26
See application file for complete search history.

(56) References Cited

U.S. PATENT DOCUMENTS 6,907,936 B2 6/2005 Fehr et al.
7,322,417 B2 1/2008 Rytlewski et al.
(Continued)

FOREIGN PATENT DOCUMENTS

WO 2012106804 8/2012

OTHER PUBLICATIONS

International Searching Authority, The International Search Report and the Written Opinion of the International Searching Authority, or the Declaration, International Application No. PCT/CA2015/050991, Filed Oct. 1, 2015, 10 pages, Receiving Office—Canadian Intellectual Property Office.

*Primary Examiner* — David J Bagnell
*Assistant Examiner* — Dany E Akakpo
(74) *Attorney, Agent, or Firm* — Richard D. Okimaw

(57) ABSTRACT

An apparatus for selectably isolating a subterranean formation from a production string comprises a radially expandable ring located between upper and lower sleeves and retained at a position to intrude into a central passage extending therethrough. The expandable ring is permitted to radially expand into a recess upon displacement of the lower sleeve to permit a body retained thereon to move therepast. The apparatus includes a pair of inner and outer indexing rings which cooperate to permit the inner and outer indexing rings to move towards a bottom end thereof only to a fixed endwall whereafter further movement of the inner and outer indexing rings and lower sleeve is prevented.

16 Claims, 20 Drawing Sheets

(51) Int. Cl.
*E21B 34/00* (2006.01)
*E21B 43/26* (2006.01)

(56) References Cited

U.S. PATENT DOCUMENTS

| | | | | |
|---|---|---|---|---|
| 2011/0108284 | A1 | 5/2011 | Flores et al. | |
| 2011/0198096 | A1 | 8/2011 | Mailand et al. | |
| 2012/0227973 | A1 | 9/2012 | Hart et al. | |
| 2013/0048291 | A1* | 2/2013 | Merron | E21B 34/063 166/305.1 |
| 2013/0233564 | A1 | 9/2013 | Pacey | |
| 2014/0174746 | A1 | 6/2014 | George et al. | |
| 2014/0262312 | A1 | 9/2014 | Tilley | |

* cited by examiner

FRACKING VALVE AND METHOD FOR SELECTIVELY ISOLATING A SUBTERRANEAN FORMATION

BACKGROUND OF THE INVENTION

1. Field of Invention

The present invention relates a method and apparatus for isolating and controlling fluid flow within a zone of a subterranean formation.

2. Description of Related Art

In hydrocarbon production, it is frequently desirable to select which zone of the wellbore is to be opened for production or to stimulate one or more zones of the well to increase production of that zone from time to time. One current method of stimulating a portion of the well is through the use of hydraulic fracturing or fracing. During fracing, it that is necessary to isolate all other zones and to hydraulically couple the desired zone to the interior of a production string to enable the producing string to provide fracing material to be the desired zone.

One conventional method of opening a fracing valve within a production string is through the use of a blocking body drop to a stop which causes a pressure build up within the desired zone thereby opening the valve. One problems with such methods is that the dropped blocking body may be frequently required to be retrived or milled from the production bore before subsequent production may begin through the production string.

SUMMARY OF THE INVENTION

According to a first embodiment of the present invention there is disclosed an apparatus for selectably isolating a subterranean formation from a production string. The apparatus comprises an elongate outer casing having an interior void extending therethrough, the outer casing having a plurality of apertures an exterior wall thereof. The apparatus further comprises an upper sleeve extending between first and second ends slidably located within the interior of the outer casing forming an annular void therebetween forming a central passage therethrough and an annular piston slidably displaceable within the void between the outer casing and the upper sleeve so as to be positionable to selectably obstruct the plurality of apertures through the outer casing. The apparatus further comprises a lower sleeve located within the interior of the outer casing below the upper sleeve biased towards the upper sleeve forming a central passage therethrough in common with the upper sleeve and an expandable ring located between the upper and lower sleeves. The apparatus further comprise a backing body located within the interior of the outer casing and having a retaining portion adapted to bias the expandable ring to radially extend inwardly into the central passage having a recess therein adapted to permit the expandable ring to expand radially outward when displaced by a predetermined distance by a first spherical object upon the expandable ring. The expandable ring selectably retains the spherical body thereon when biased inwardly by the retaining portion of the backing body so as to be operable to pressurize the central passage thereabove such that the pressure displaces the annular piston so as to uncover the apertures.

The backing body may comprise a retaining sleeve surrounding the expandable ring. The retaining portion may comprise a retaining ring surrounding the expandable ring. The retaining sleeve may be longitudinally slidably located within the void between the outer casing and the upper sleeve. The retaining sleeve may include a recessed portion to receive the retaining ring thereinto when longitudinally displaced within the void.

The upper sleeve may be slidably located within the outer casing. The expandable ring may expand into a void above the retaining portion as the upper sleeve retracts towards a top end of the outer casing.

The apparatus may further comprise an indexing assembly for permitting a predetermined number of spherical objects to pass thereby before retaining a next spherical object. The indexing assembly comprises a plurality of outer casing teeth inclined towards a bottom end of the outer casing extending radially outwardly from the lower sleeve into the void and a plurality of lower sleeve teeth inclined towards a bottom end of the outer casing extending radially inwardly from the outer casing into the void. The first and second interlinked indexing rings are located within the void between the outer casing and the lower sleeve, each of the first and second indexing ring having corresponding teeth with the outer casing teeth and the lower sleeve teeth so as to operable to be displaced by a predetermined distance when the sleeve is displaced from the first to the second position and remain at the predetermined distance when the sleeve returns to the first position.

The first and second indexing rings include corresponding teeth therebetween. The first and second indexing rings may include an annular wall extending from one of the first and second indexing rings into a longitudinally extending cavity formed in an other of the first and second indexing rings.

The apparatus may further comprise an end stop within the void to prevent further longitudinal movement of the first and second indexing rings. The end stop may comprise a selectably longitudinally movable sleeve. The end stop sleeve may be released to be biased towards a first end of the outer casing after being depressed by the first and second indexing rings. The apparatus may further comprise a radially expandable ring adapted to expand into a void between the end stop sleeve and the outer casing after the longitudinal movement of the end stop sleeve.

According to a further embodiment of the present invention there is disclosed a method for selectably isolating a subterranean formation from a production string. The method comprising engaging a blocking body upon a radially expandable ring within an outer casing, applying a pressure to a top surface of the blocking body so as to bias the expandable ring and a lower sleeve towards a lower end of the outer casing and permitting the expandable ring to expand into a recess in the outer casing to permit the blocking body to move therepast. The method further comprises biasing the lower sleeve and the retaining ring back to an initial position, after a predetermined quantity of blocking bodies have moved therepast, prevent the lower sleeve from further displacement to the recess and applying an opening pressure to the top surface of the blocking body to pressurize an annular void between an upper sleeve and the outer casing to displace an annular piston located therebetween thereby uncovering ports extending through the outer casing.

The step of determining a predetermined quantity of blocking bodies to move therepast may comprise engaging a inner indexing ring upon inclined teeth extending from an outer surface of the lower sleeve and engaging an outer indexing ring upon inclined teeth extending from an inner surface of the outer casing. The step of determine may further comprise engaging the inner and outer indexing rings together to remain within a fixed range relative to each other wherein the inclined teeth of the outer casing and the inner sleeve cooperate to permit the inner and outer indexing rings to move towards a bottom end thereof only to a fixed endwall whereafter further movement of the inner and outer indexing rings and lower sleeve is prevented.

According to a further embodiment of the present invention there is disclosed an apparatus for permitting a predetermined number of spherical bodies to pass thereby before retaining a blocking spherical body. The apparatus comprises an elongate housing having a radially expandable ring at a first end of a longitudinally displaceable sleeve within the housing. The sleeve and ring are displaceable between first and second positions wherein the expandable ring is retained in a radially inwardly compressed configuration at the first position and expanded to a full diameter of the sleeve at the second position. The apparatus further includes first and second mated indexing rings between the housing and the sleeve coupled to the housing and sleeve with unidirectional teeth so as to be displaced by a predetermined distance when the sleeve is displaced from the first to the second position and remain at the predetermined distance when the sleeve returns to the first position.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
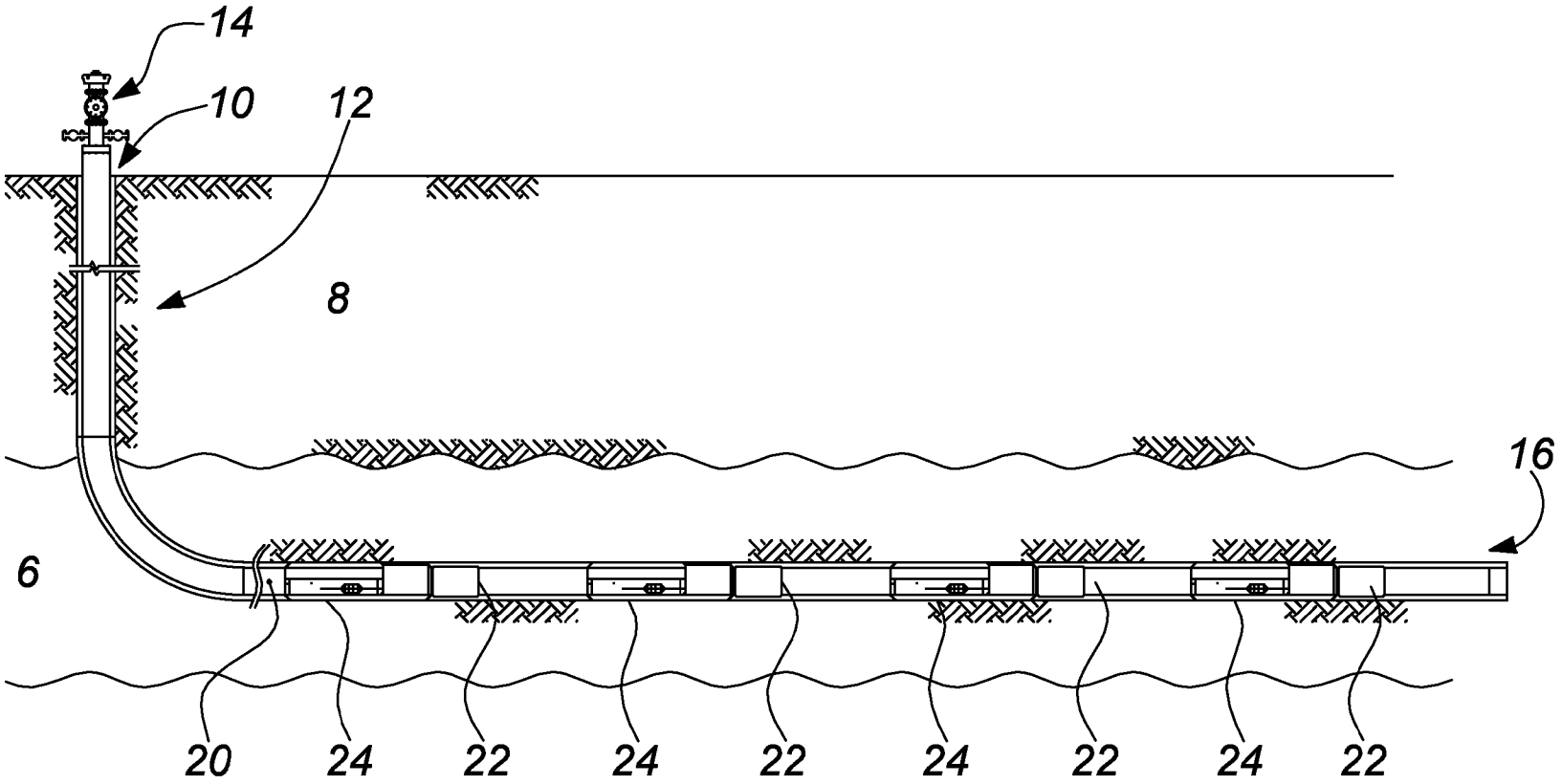
FIG. 1 is a cross-sectional view of a wellbore having a plurality of flow control valves according to a first embodiment of the present invention located therealong.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be horizontal or angularly oriented relative to the horizontal located within the production zone 6. After the wellbore 10 is drilled the production tubing 20 is of the hydrocarbon well is formed of a plurality of alternating liner or casing 22 sections and an apparatus 24 for selectably permitting fluid flow between the interior of the liner and the formation surrounded by a layer of cement 23 between the casing and the wellbore. The valve bodies 24 are adapted to control fluid flow from the surrounding formation proximate to that valve body and may be located at predetermined locations to correspond to a desired production zone within the wellbore. It will be appreciated that packers as are commonly known may be located between valves to isolate the zones from each other. In operation, between 8 and 100 valve bodies may be utilized within a wellbore although it will be appreciated that other quantities may be useful as well.

Figure 2:
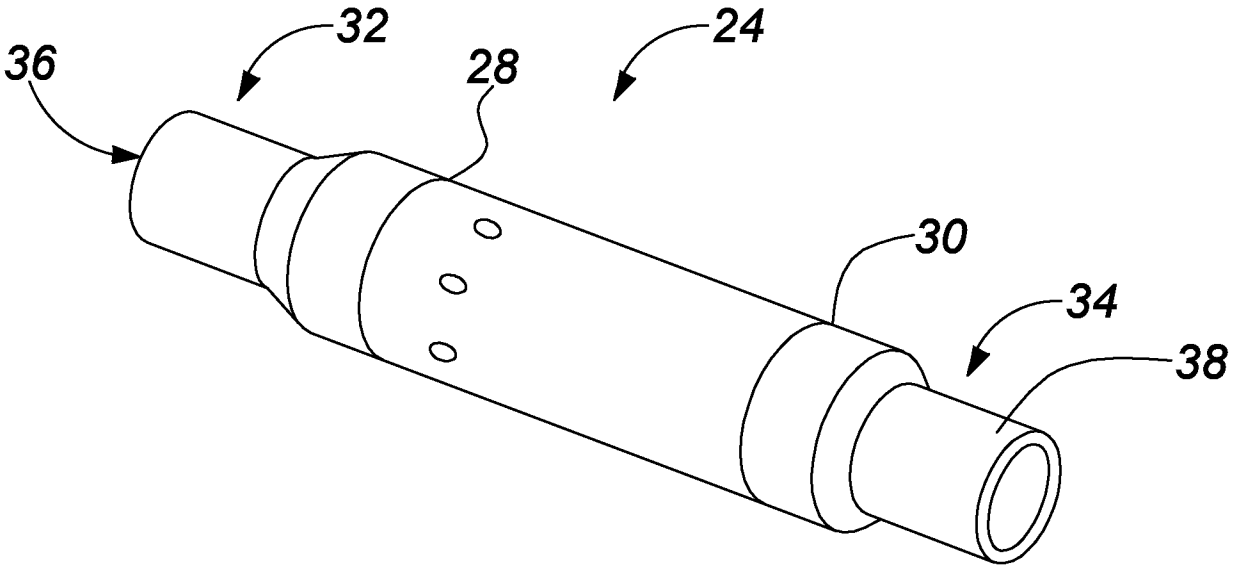
FIG. 2 is a perspective view of an apparatus for selectably isolating a subterranean formation according to a first embodiment of the present invention.
Figure 3:
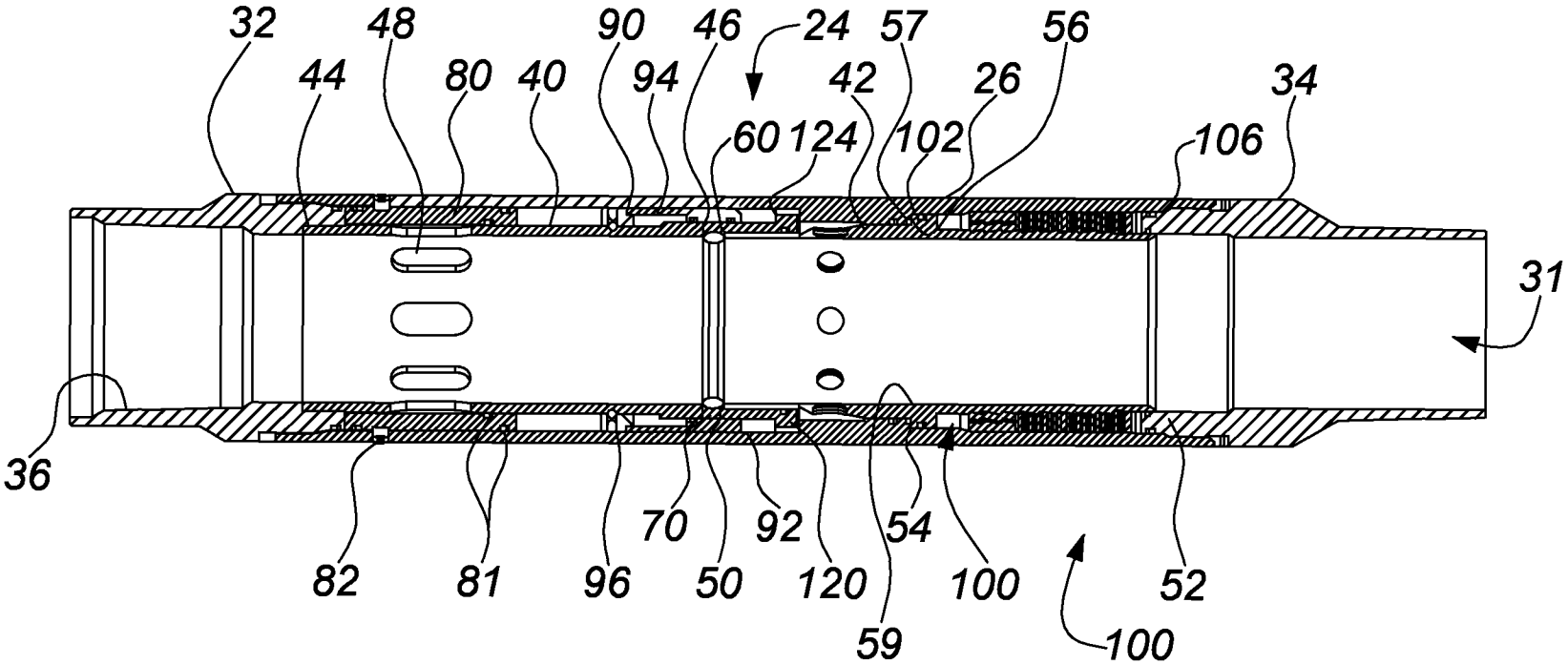
FIG. 3 is a cross sectional view of the apparatus of FIG. 1 as taken along the line 2-2 at a first or run in position.

Turning now to FIGS. 2 and 3, one apparatus 24 for use as a valve in accordance with one embodiment of the present invention is illustrated. The apparatus 24 comprises a substantially elongate cylindrical outer casing 26 extending between first and second ends 28 and 30, respectively and having a central passage 31 therethrough. The apparatus further includes a top cap 32 connected to the first end 28 of the valve body and a bottom cap 34 connected to the second end of the valve body. Each of the top and bottom caps 32 and 34 include a tubular portion extending therefrom having external threading for engaging within corresponding internal threading on the first and second ends 28 and 30 of the outer casing 26. The top cap 32 also includes internal threading 36 therein and the bottom cap 34 includes external threading 38 for connection to adjacent casing sections.

The apparatus 24 also includes upper and lower sleeves 40 and 42, respectively located within the outer casing between the top and bottom caps 32 and 34. The upper sleeve 40 comprises a cylindrical body extending between first and second ends, 44 and 46, respectively and having a plurality of ports 48 therethrough. The first end 44 of the upper sleeve is threadably or otherwise secured within the bottom end of the top cap 32 and may also be sealed therewith. The lower sleeve 42 comprises a cylindrical body extending between first and second ends, 50 and 52, respectively and is slidably received within the casing 26 above the bottom cap 34 as will be more fully described below. At the first or run-in position as illustrated in FIG. 3, the upper and lower sleeves 40 and 42 include a radially expandable split ring 60 and a retaining ring 70 therebetween. The split ring 60 and retaining ring 70 are radially expandable wherein the split ring 60 has an internal diameter sized to be smaller than the central passage so as to receive and retain a dropped blocking body (not shown) thereon. The retaining ring 70 is sized slightly larger than the split ring and is sized to retain the split ring 60 at the reduced cross sectional area during run-in.

The apparatus 24 further includes a valve sleeve 80 slidably located between the outer casing 26 and the upper sleeve 40. The valve sleeve is sealably located between the outer casing and upper sleeve 40 by seals 81 and the like. The valve sleeve 80 is secured to the outer casing 26 at an initial position by at least one shear pin 82. A shear retaining sleeve 90 is also located between the outer casing 26 and the upper and lower sleeves 40 and 42. The shear retaining sleeve includes a widened portion 92 and a recessed portion 94 wherein the widened portion 92 is positioned behind the retaining ring 70 during run-in to retain the retaining ring and thereby the split ring 60 at the restricted positions. The shear retaining sleeve 90 is secured to the upper sleeve 40 at an initial position by at least one shear pin 96. A recess ring 120 is provided around a top end of the lower sleeve between the retaining ring 70 and an enlarged portion 25 in the outer casing. The recess ring 120 has an outer surface sized to retain the split ring 60 at the compressed configuration with a recess groove 122 therearound adapted to permit the split ring 60 to expand thereinto thereby permitting the split ring 60 to expand to the diameter of the central passage 31. The recess groove 122 is located at a position such that the indexing section will be displaced by a desired distance as described below until all permitted displacements have occurred wherein the additional displacements will not be sufficient for the split ring 60 to reach the recess groove 122 thereby preventing further blocking bodies from passing thereby.

The lower sleeve 42 includes an enlarged portion 54 having an end face 56 oriented towards a corresponding annular surface 57 extending from the casing 26 wherein the faces 56 and 57 form a sealed annular cavity 59 therebetween at atmospheric pressure. As illustrated in FIG. 3, and described in greater detail below, the casing 26 and lower sleeve 42 include an indexing section, generally indicated at 100 therebetween adapted to count a number of blocking bodies dropped past the apparatus before preventing further blocking body drops.

Figure 4:
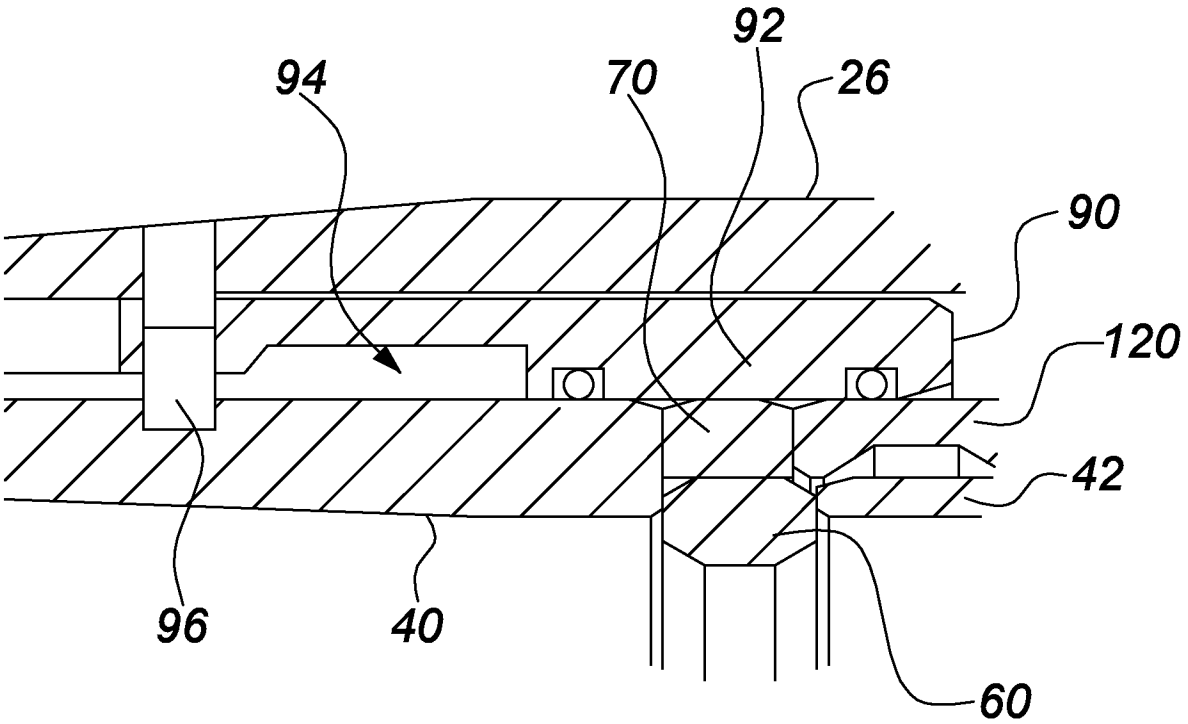
FIG. 4 is a detailed cross-sectional view of the blocking body retaining means of the apparatus of FIG. 1 at the first or run in position.
Figure 5:
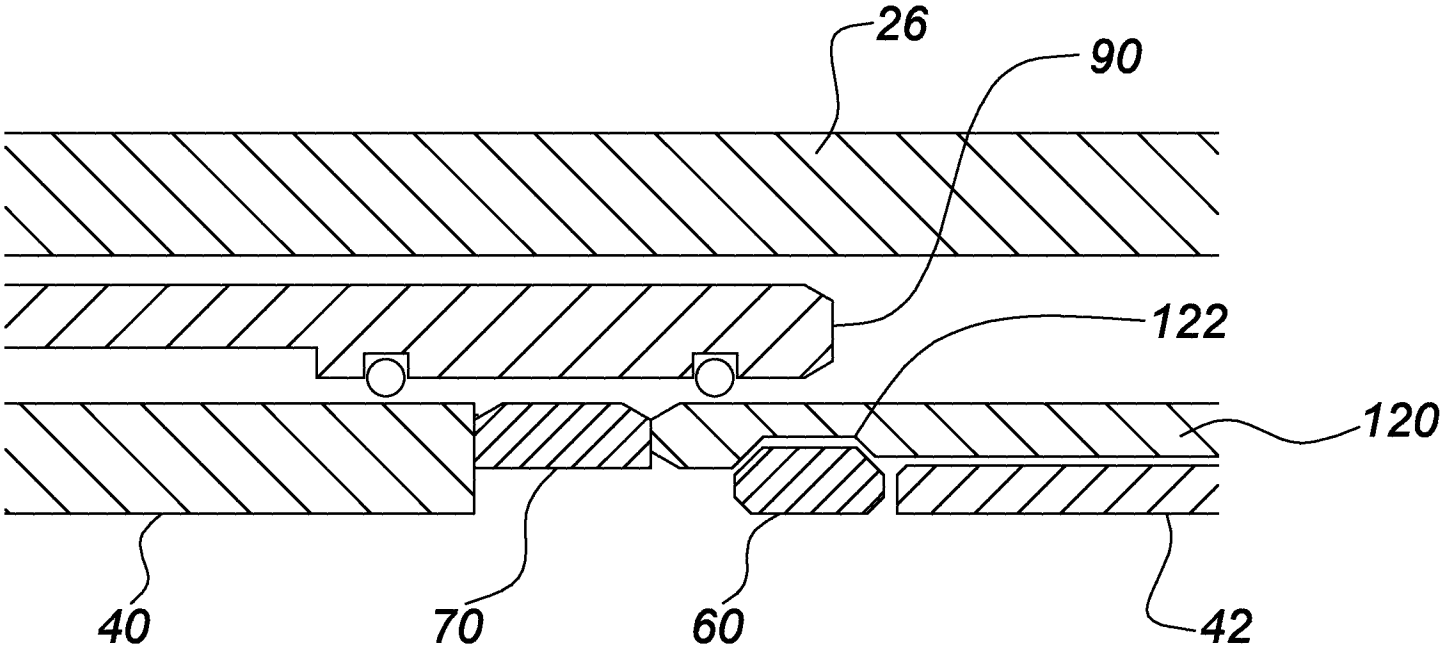
FIG. 5 is a detailed cross-sectional view of the blocking body retaining means of the apparatus of FIG. 1 at the second or passing position.
Figure 6:
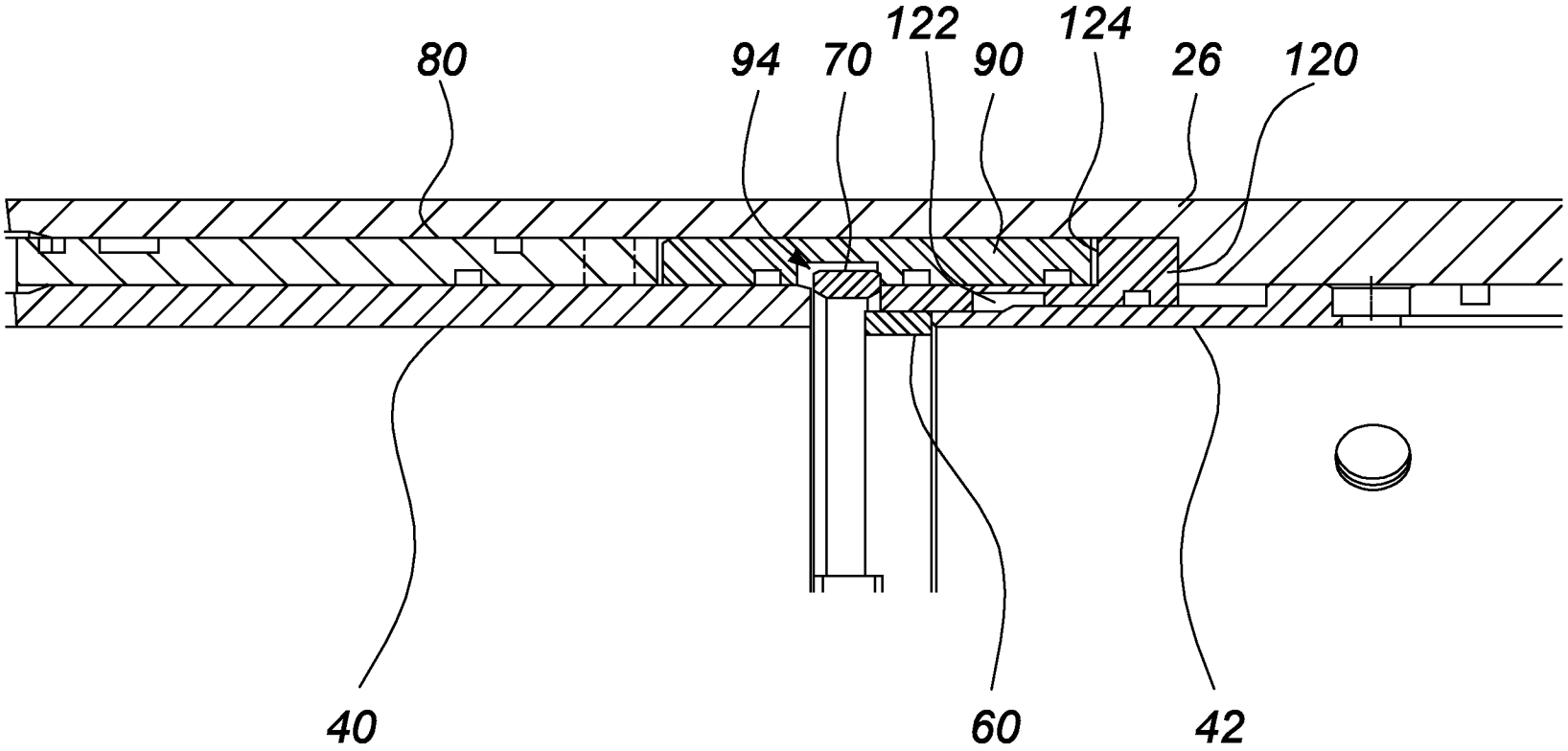
FIG. 6 is a detailed cross-sectional view of the blocking body retaining means of the apparatus of FIG. 1 at the third or fracing position.

With reference to FIGS. 4 through 7, the split ring 60 is located longitudinally between the upper and lower sleeves 40 and 42 and is radially expandable within the central passage 31 of apparatus 24 so as to be operable to either retain or permit the passage of a drop blocking body therepast. As illustrated in FIG. 4, at the first or run in position, the split ring 60 is retained at the radially compressed position to prevent blocking bodies from passing by the retaining ring 70. When a blocking body such as a dropped ball as are commonly known (not shown) is dropped down the string it will encounter and be retained upon the split ring 60. Pressure applied to the production string above the blocking body will cause the split ring 60 and lower sleeve 42 to be displaced in a downward direction to the second position illustrated in FIG. 5 wherein the split ring 60 will encounter the recess groove 122 thereby expanding to the diameter of the central passage permitting the blocking body to continue down the production string. The atmospheric pressure within the annular cavity 59 will thereafter bias the lower sleeve 42 and the split ring 60 back to the first position shown in FIG. 4. Once the indexing section 100 has permitted the designated number of blocking bodies to pass thereby as will be more fully described below, a blocking body dropped down the production string will again encounter and be retained by the split ring 60. Thereafter pressure applied above the blocking body will displace the split ring 60 and lower sleeve 42 in a downward direction, however the indexing section will not permit a sufficient displacement for the split ring 60 to reach the recess groove 122 as illustrated in FIG. 6. At such position, further pressure applied above the blocking body to open the valve sleeve 80 to perform the frac.

Figure 7:
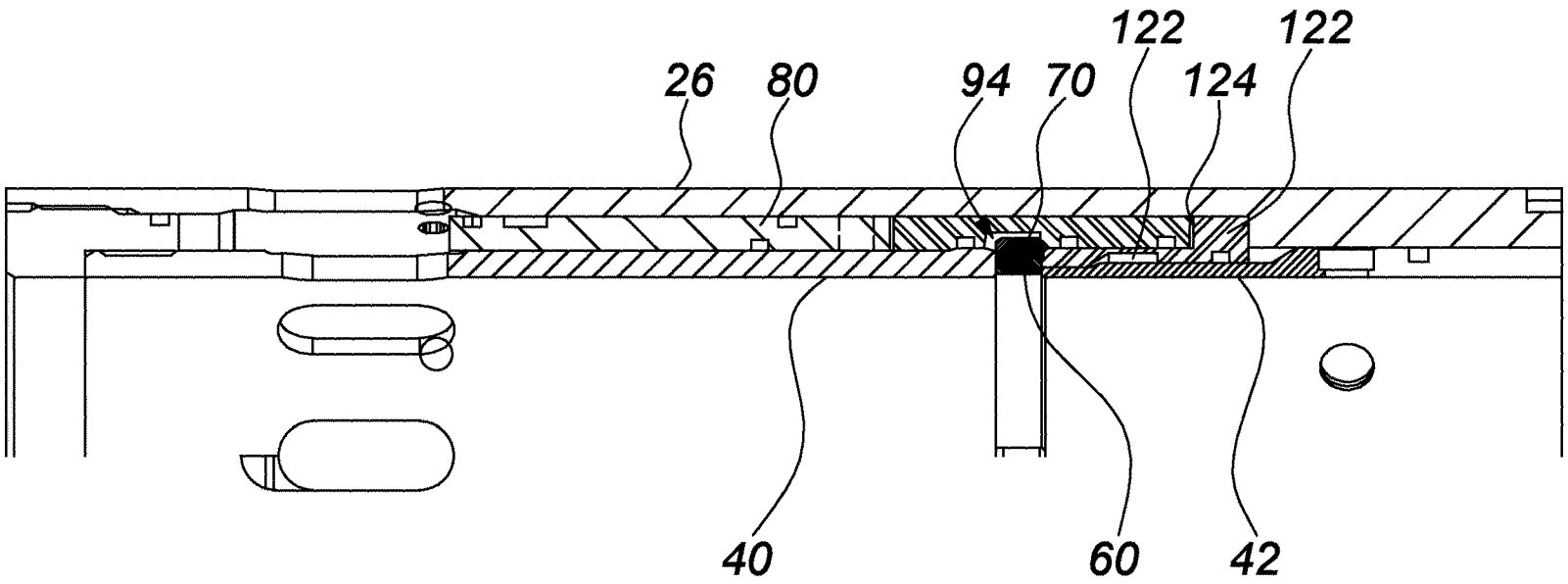
FIG. 7 is a detailed cross-sectional view of the apparatus of FIG. 1 at a fourth or full gauge position.

As illustrated in FIG. 3, the valve sleeve 80 is sealed to the outer casing 26 as well as to the upper sleeve 40 below the ports 48. However the valve sleeve 80 is not sealed to the upper sleeve 40 above the ports 48 thereby permitting fluid to pass therepast to a position between the valve sleeve 80 and the top cap 32. When the pressure reaches amount the shear pins 82 will be sheared thereby displacing the valve sleeve 80 towards the bottom cap 34 until engaging upon the retaining sleeve 90 whereafter the shear pin 96 will also be sheared also displacing the retaining sleeve 90 into contact with a upright surface 124 on the recess ring 120 as illustrated in FIG. 6. At this position, the retaining sleeve 70 is permitted to expand into a recessed portion 94 of the retaining sleeve 90. Thereafter, when the frac has been completed, the pressure above the blocking body may be reduced permitting the atmospheric pressure within annular cavity 59 to bias the split ring 60 and lower sleeve 42 in an upward direction. Upon encountering the upper sleeve 40, the split ring 60 no longer has the retaining ring 70 positioned to retain it at the radially compressed configuration whereupon it is permitted to expand into the void left by the retaining ring 70 thereby permitting the blocking body to drop as illustrated in FIG. 7. Thereafter further blocking bodies will be permitted to freely move therepast.

Turning now to FIGS. 8 through 11, the indexing section is illustrated in detail. The indexing section comprises inner and outer ratchet rings 112 and 114 engaged with each other by annular ridges 116 and 118, respectively so as to permit radial movement of the rings relative to each other but to prevent longitudinal displacement therebetween. The outer surface of the lower sleeve 42 includes ratchet teeth having angled surfaces 108 oriented towards the top cap 32 and upright surfaces 110 oriented towards the bottom cap 34. Similarly, the outer casing 26 includes teeth 109 with upright surfaces oriented towards the bottom cap 34. The inner ratchet ring 112 includes forwardly inclined teeth with an upright surface 130 oriented towards the top cap 32 while the outer ratchet ring 114 includes corresponding backwardly oriented teeth 132.

Figure 8:
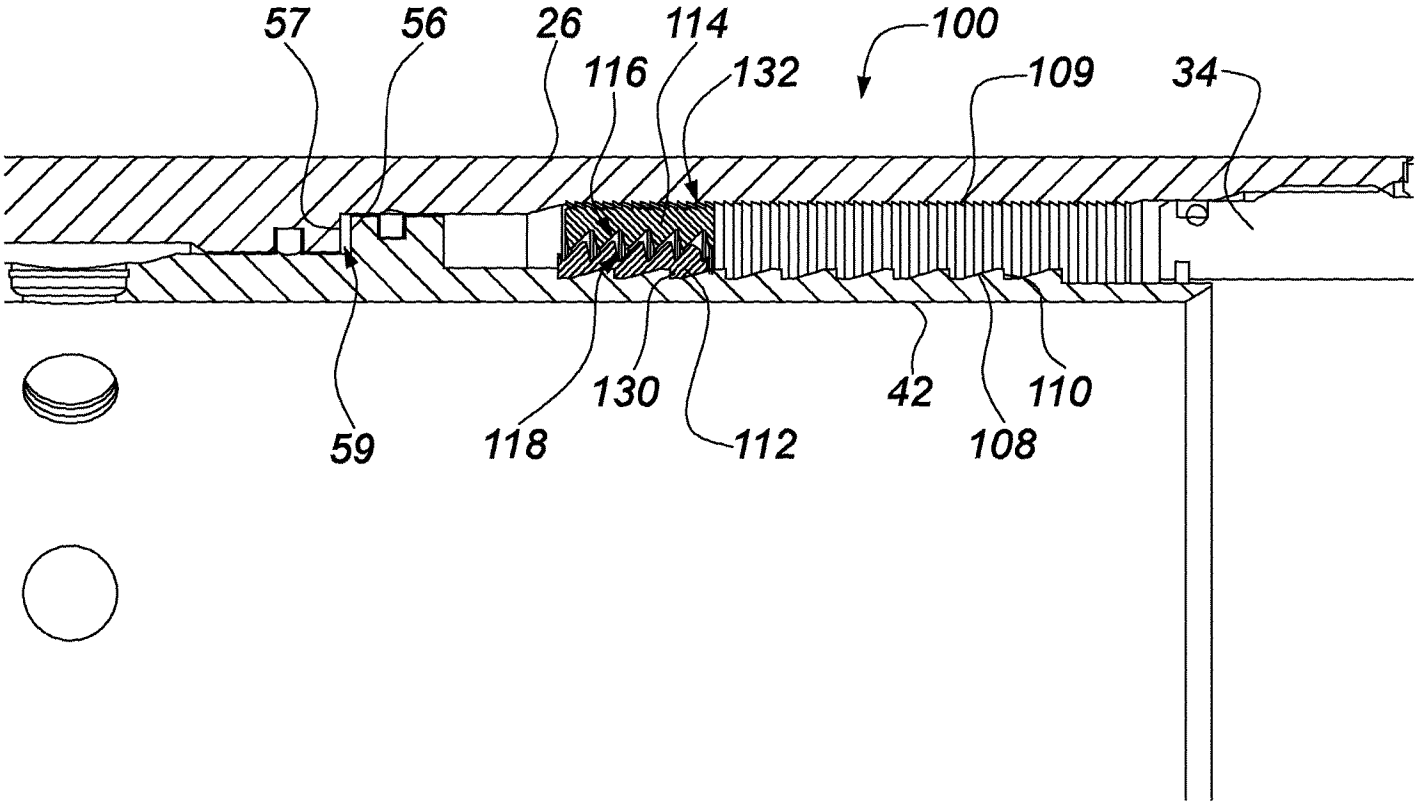
FIG. 8 is a detailed cross-sectional view of the ratchet rings of the apparatus of FIG. 1 at a first or run in position.
Figure 9:
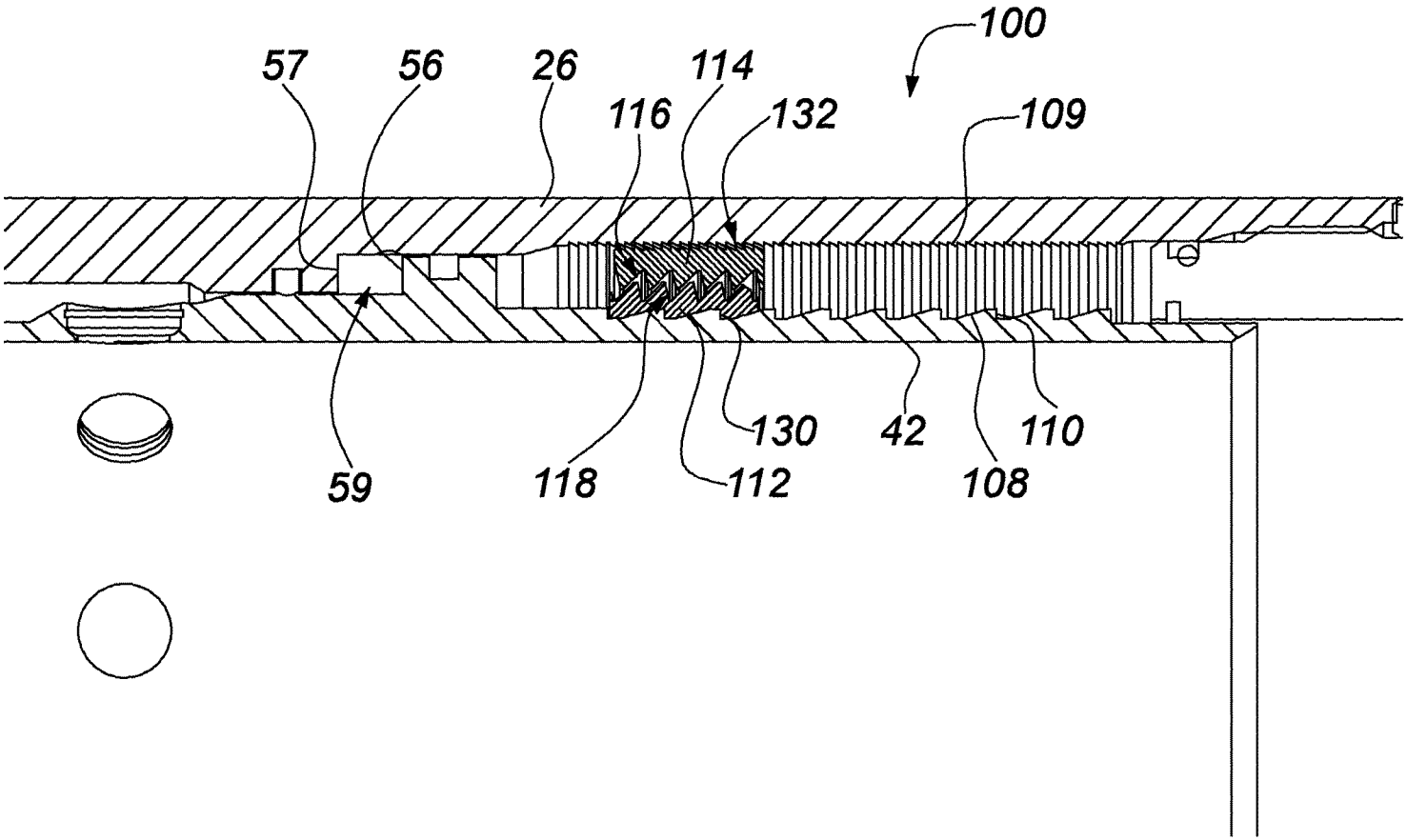
FIG. 9 is a detailed cross-sectional view of the ratchet rings of the apparatus of FIG. 1 at a second or displaced position.
Figure 10:
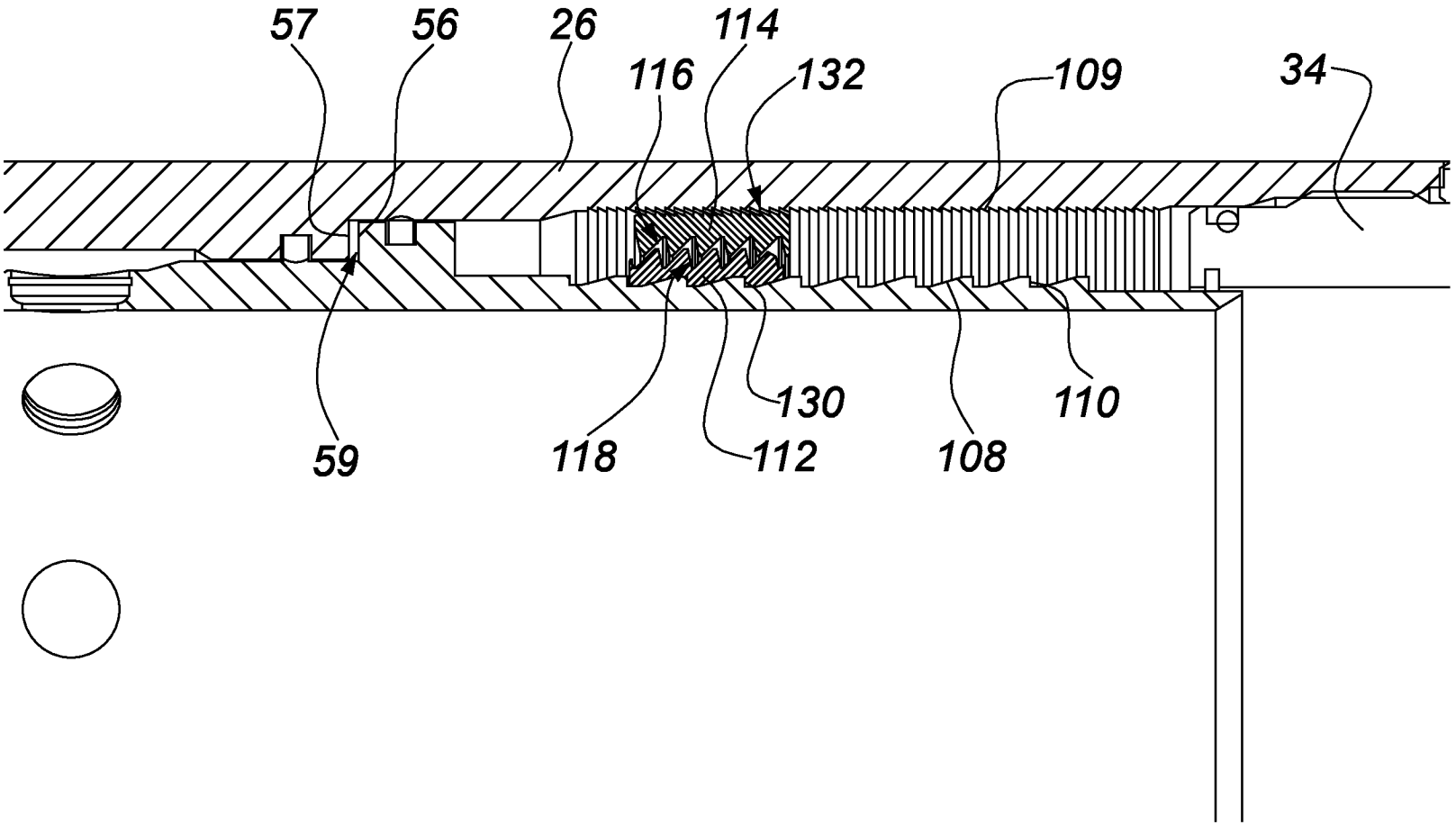
FIG. 10 is a detailed cross-sectional view of the ratchet rings of the apparatus of FIG. 1 at a third or return position.
Figure 11:
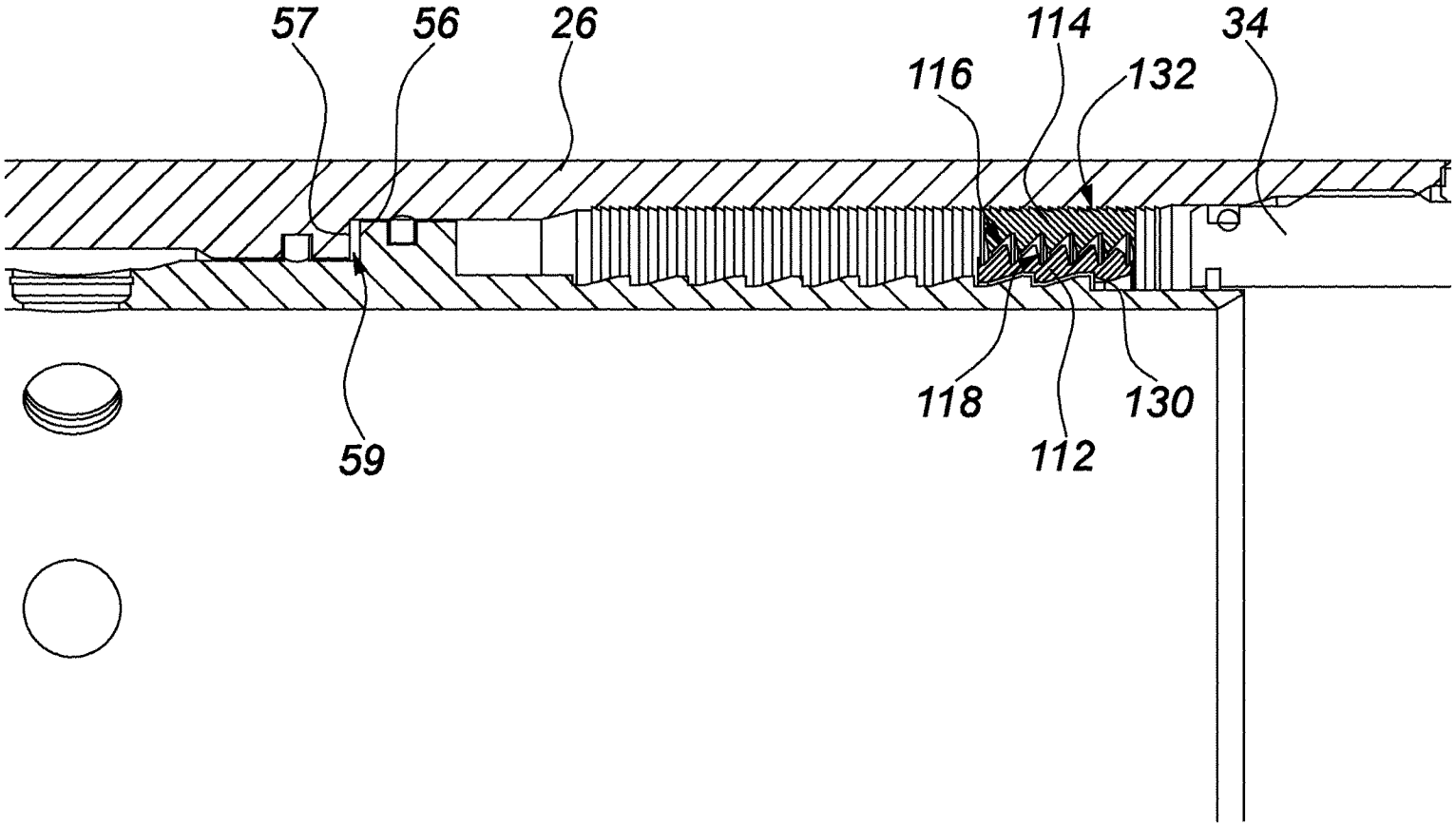
FIG. 11 is a detailed cross-sectional view of the ratchet rings of the apparatus of FIG. 1 at a fourth or end position.

In operation, as a lower sleeve 42 is displaced from the first to second positions as illustrated by FIGS. 4 and 5 above, the ratchet rings 112 and 114 will be displaced from the initial position shown in FIG. 8 to the lower position shown in FIG. 9 by the movement of the lower sleeve 42 drawing the inner and thereby the outer ratchet rings therealong. After the blocking body has been dropped and the split ring 60 returned to the initial position, the lower sleeve 42 also returns to the initial position, however the teeth 109 on the casing 26 retain the outer ratchet ring 114 and therefore also the inner ratchet ring 112 in the displaced position as illustrated in FIG. 10. Subsequent displacements of the lower sleeve 42 will continue to move the inner and outer ratchet rings towards the bottom cap 34 until positioned adjacent thereto as illustrated in FIG. 11. Thereafter subsequent attempts to displace the ratchet rings 112 and 114 will cause them to engage upon the bottom cap 34 thereby preventing further displacement. As discussed above, this position also corresponds to the position of the split ring 60 as illustrated in FIG. 6 whereafter the frac may be completed.

Figure 12:
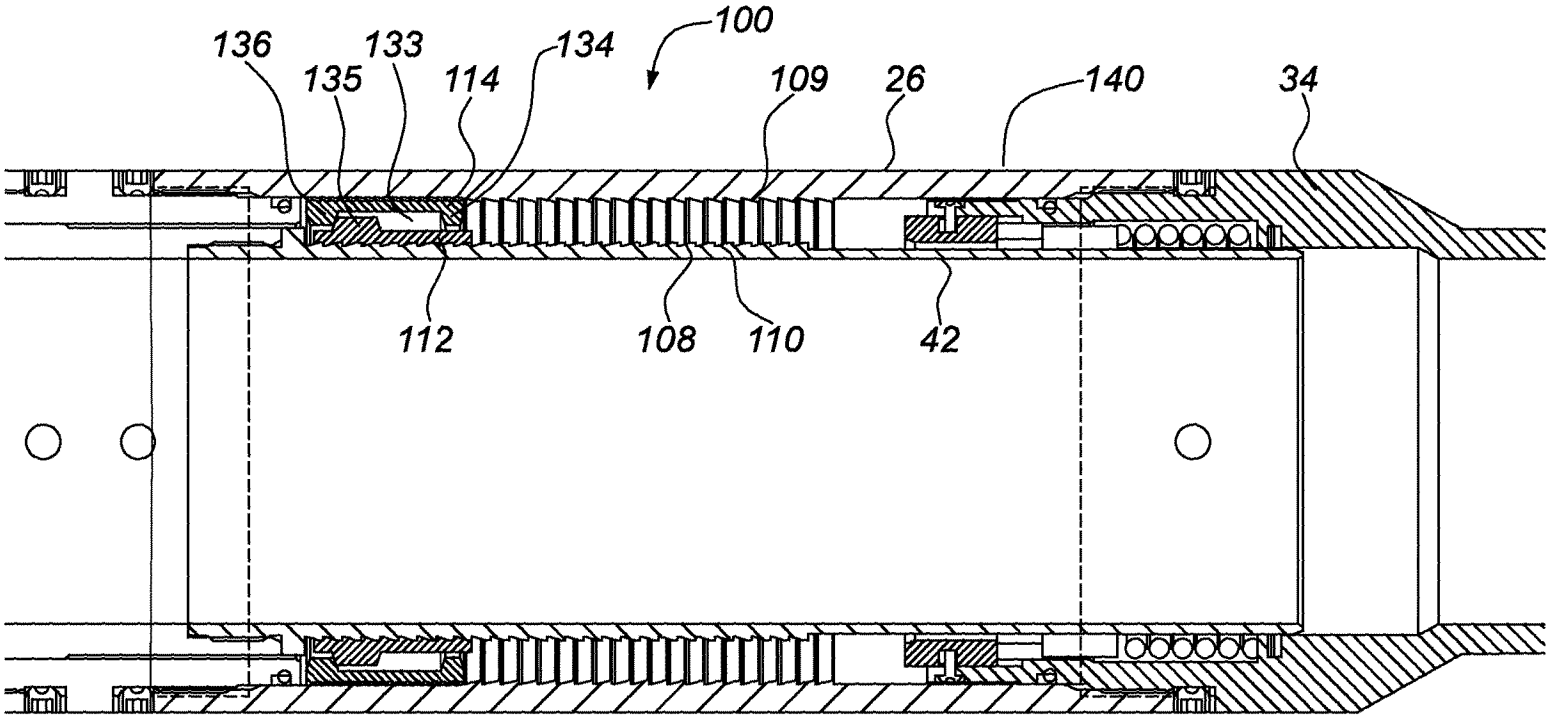
FIG. 12 is a detailed cross-sectional view an indexing section according to a further embodiment of the present invention at a first or run in position.
Figure 13:
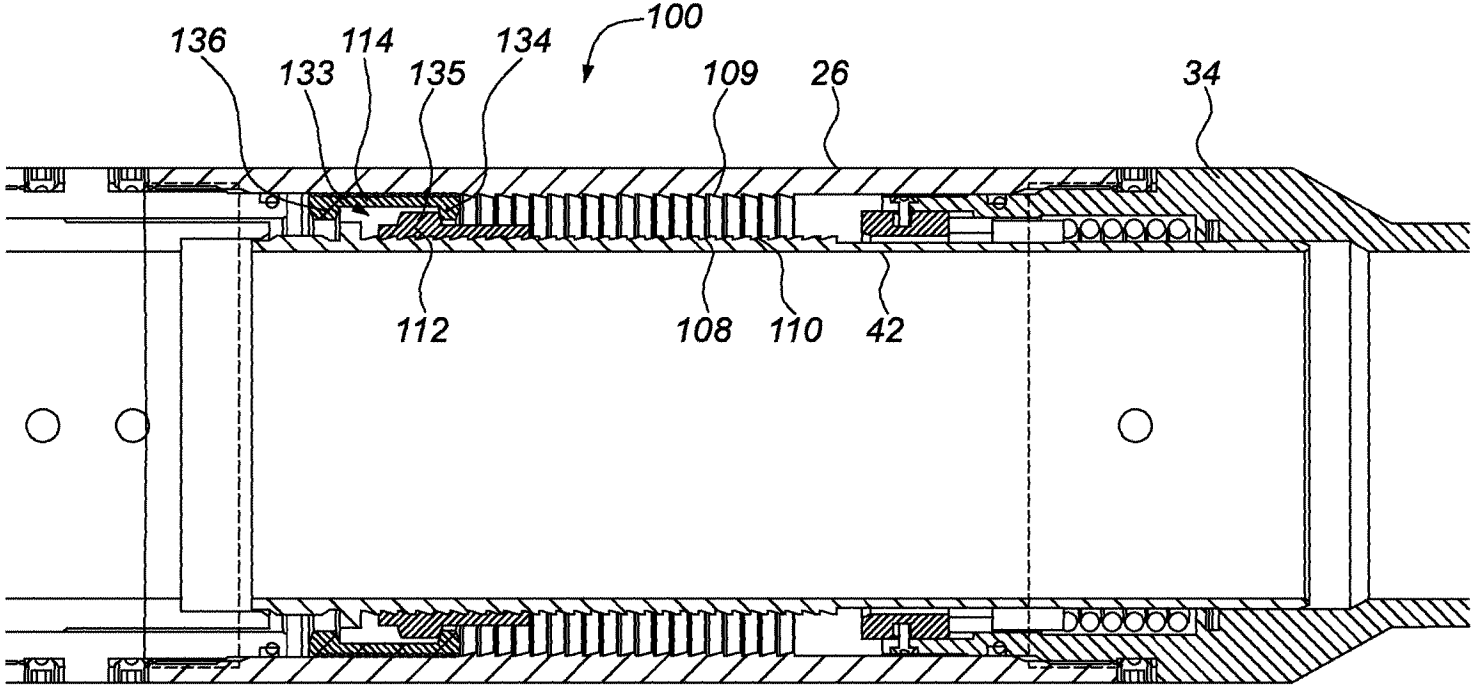
FIG. 13 is a detailed cross-sectional view of the indexing section of the apparatus of FIG. 12 at a second or displaced position.
Figure 14:
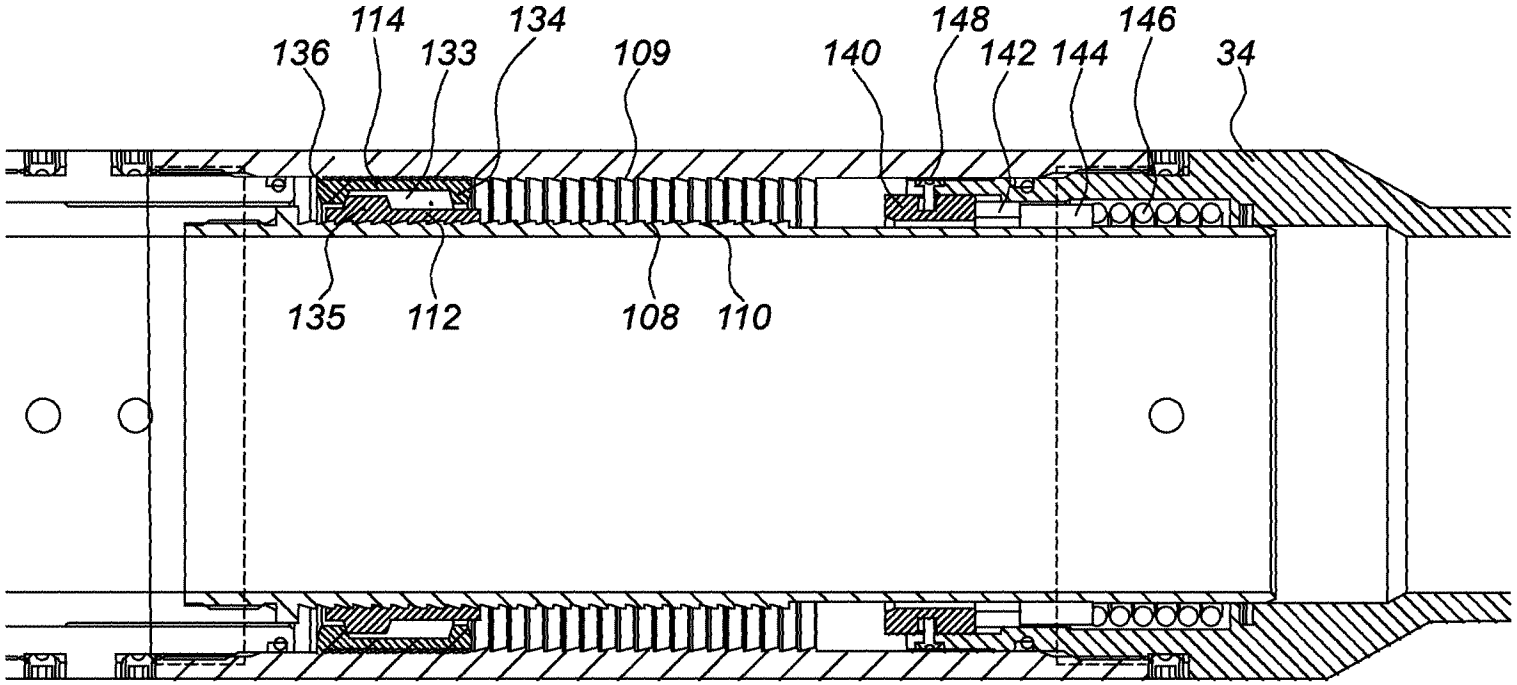
FIG. 14 is a detailed cross-sectional view of the indexing section of the apparatus of FIG. 12 at a third or return position.

Turning now to FIGS. 12 through 15, an alternative embodiment of the indexing section is illustrated. As illustrated in FIGS. 12 through 15, the inner ratchet ring 112 may include an annularly protruding wall 135 extending therefrom received within an inwardly oriented cavity 133 in the outer ratchet ring 114. The outer ratchet ring includes bottom and top end walls 134 and 136, respectively at either end thereof defining the cavity 133. As illustrated in FIGS. 12 and 13, the movement of the lower sleeve 42 moves the protruding wall 135 to encounter the bottom end wall 134 which thereafter displaces the outer ratchet ring 114 by a shorter distance. Similarly return of the lower sleeve 42 to the starting position permits the inner ratchet ring to move independently until the protruding wall 135 encounters the top end wall 136 as illustrated in FIG. 14. In such a manner, it will be appreciated that a similar range of motion of the lower sleeve 42 will result is a shorter displacement of the inner and outer ratchet rings 112 and 114 thereby permitting a greater number of blocking body drops before the final or fracing blocking body is dropped. In operation, the inner and outer ratchet rings 112 and 114 are positioned along the teeth 109 and 110 such that a given number of blocking bodies will be permitted to pass before retaining the next blocking body. Accordingly, the bottom most valve will be positioned such that the first blocking body to reach that valve will be retained. Similarly, the second valve from the bottom will be set up such that the second blocking body to reach that valve will be retained wherein the first blocking body will be passed through to the bottom valve.

Figure 15:
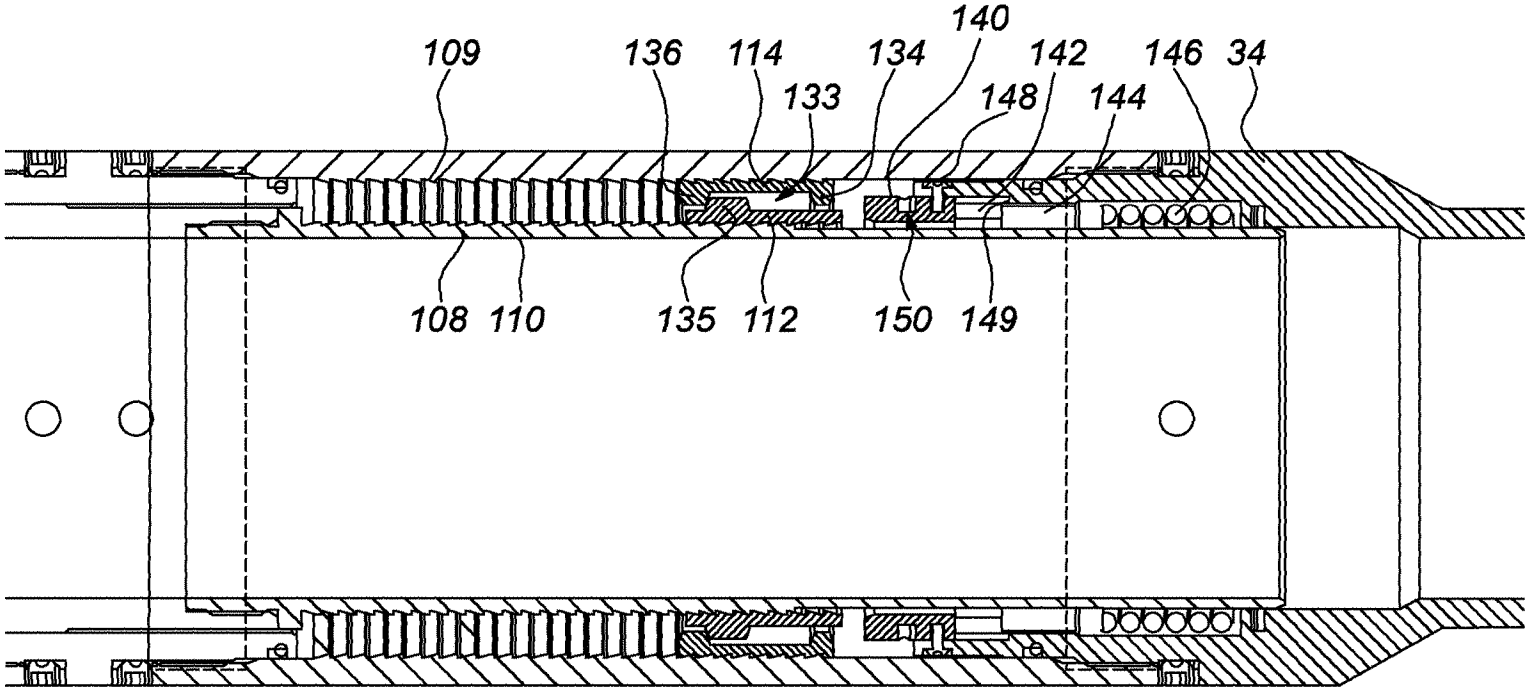
FIG. 15 is a detailed cross-sectional view of the indexing section of the apparatus of FIG. 12 at a fourth or end position.
Figure 16:
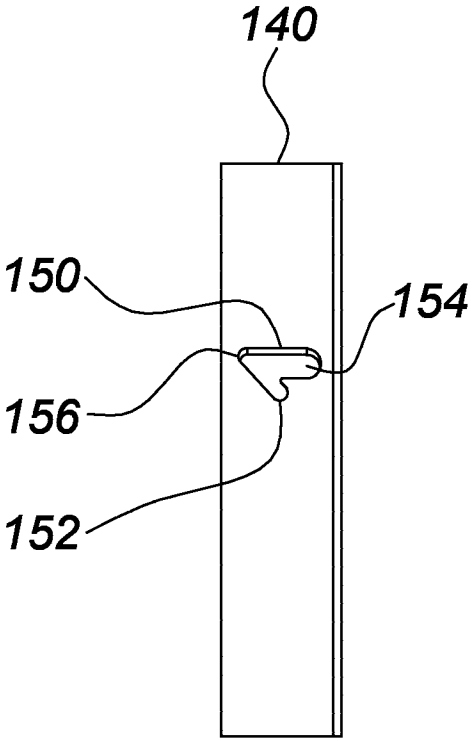
FIG. 16 is a side view of the J-slot ring of the apparatus of FIG. 12.

As illustrated in FIG. 15, the indexing assembly 100 may also include an end stop engagement ring 140 adapted to be extended towards the ratchet rings 112 and 114 upon being depressed by the inner ratchet ring 112. The end stop engagement ring 140 may be located proximate to the top end of the bottom cap 34 and retained therein by screws or pins 148 extending radially inward from the end cap 34. The pins 148 are received in j-shaped slots 150 as shown in FIG. 16 which retain the end stop engagement ring 140 at the retracted position at the run in position. As illustrated in FIG. 14, the end stop engagement ring 140 also includes a radially expandable ring 142 a displacement ring 144 and a spring 146 received within a cavity formed between the bottom cap 34 and the lower sleeve 42. With reference to FIG. 16, the j-shaped slots 150 include a short arm 152 adapted to maintain the end stop engagement ring 140 at a retracted position illustrated in FIG. 14 and a long arm 154 adapted to permit the end stop engagement ring 140 to move to an extended position illustrated in FIG. 15. As the end stop engagement ring is depressed, the pin 148 is moved from the short arm 152 to the bottom junction 156 and thereafter permitted to move into the long arm as the inner ratchet ring 112 is disengaged from the end stop engagement ring 140. After being disengaged from the inner ratchet ring 112, the end stop engagement ring 140 is biased to the extended position illustrated in FIG. 15 by the spring 146 acting upon the displacement ring 144 which displaces the ring 142 into a void which permits it to expand radially outward thereby engaging and being retained at the extended position by engagement upon a lip 149 on the inner surface of the bottom cap. In such a manner, the end stop engagement ring 140 will be retained at the extended position thereby preventing further blocking bodies from passing.

Figure 17:
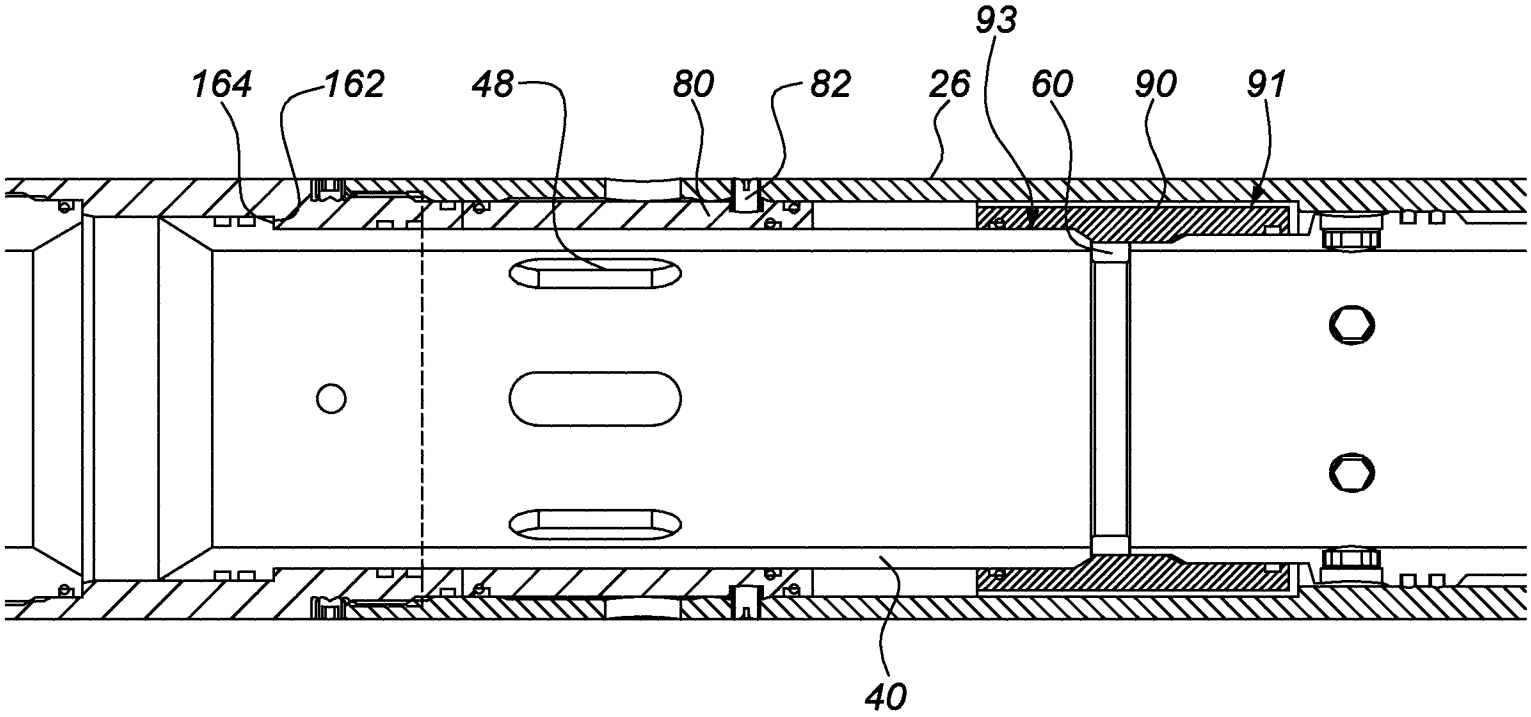
FIG. 17 is a detailed cross-sectional a blocking body retaining means of the apparatus of FIG. 1 according to a further embodiment of the present invention
Figure 18:
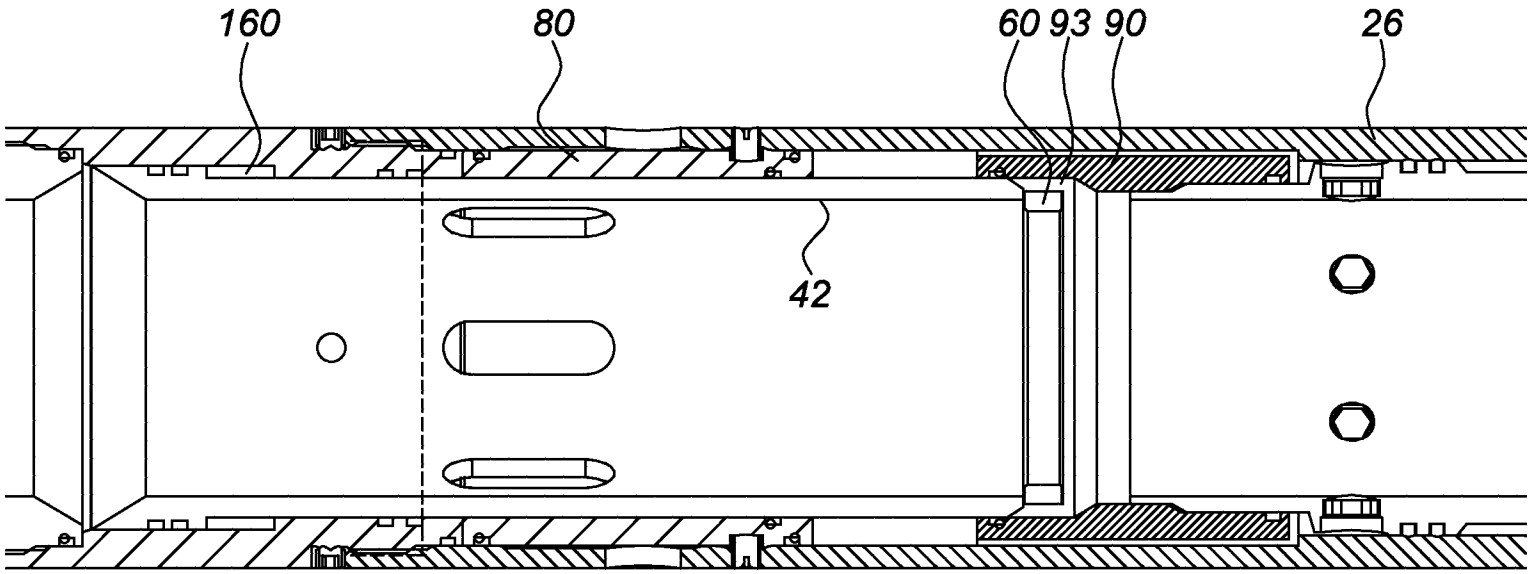
FIG. 18 is a detailed cross-sectional a blocking body retaining means of the apparatus of FIG. 1 according to a further embodiment of the present invention
Figure 19:
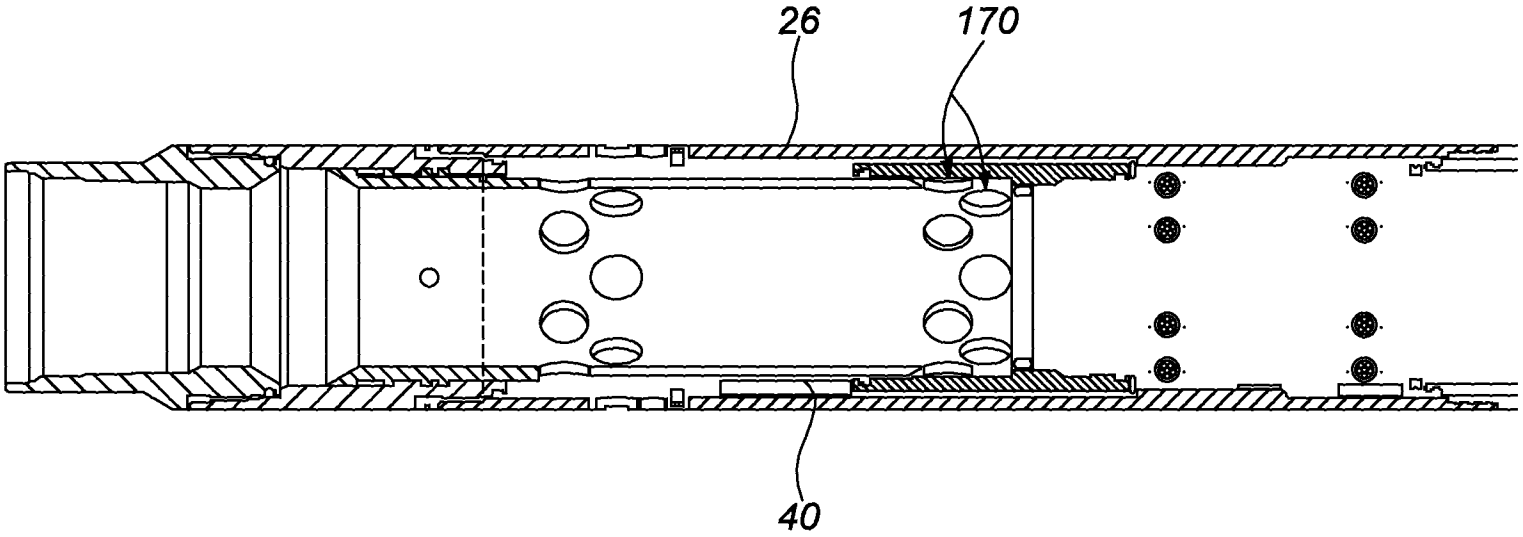
FIG. 19 is a detailed cross-sectional a blocking body retaining means of the apparatus of FIG. 1 according to a further embodiment of the present invention

Turning now to FIG. 17, an alternative embodiment of the present invention is illustrated. As illustrated in the embodiments of FIGS. 17 through 19, the blocking body retaining means does not include a retaining ring 70 and therefore it will be appreciated that the blocking body will not be permitted to pass through the valve after the frac has been completed, but rather is retained at that valve for retrieval or further use as will be more fully described below. As illustrated in FIG. 17, the upper sleeve 40 may be slidably located within the casing 26 such that an outwardly extending wall 162 from the upper sleeve 40 engages upon an inwardly extending wall 164 from the casing 26. Seals are provided to each side of this connection to maintain a void 160 sealed at atmospheric pressure during run in. After the frac has been completed, the pressure above the blocking body may be reduced permitting well bore pressure below the blocking body to bypass sheer retaining sleeve 90 through milled slots 91 around the exterior thereof. The greater pressure below the blocking body will also press the blocking body into the split ring 60 thereby displacing the split ring 60 and upper sleeve 40 as set out above until the split ring is permitted to expand into a widened portion of the retaining sleeve 90 thereby permitting the blocking body to pass thereby for retrieval. Thereafter further reducing the pressure above the blocking body will retract the blocking body from the valve and cause a blocking body from a valve below the preset valve to encounter the split ring 60 from the bottom surface thereby forming a greater pressure below the blocking body and a net force upwards thereon. This upwards force will displace the blocking body (not shown) and the upper sleeve 40 towards the top cap 32 as illustrated in FIG. 18 against the vacuum formed in chamber 160 until the split ring 60 is permitted to expand into a top recess 93 in the shear retaining sleeve 90 thereby permitting the blocking body to pass and be retrieved by an operator.

Figure 20:
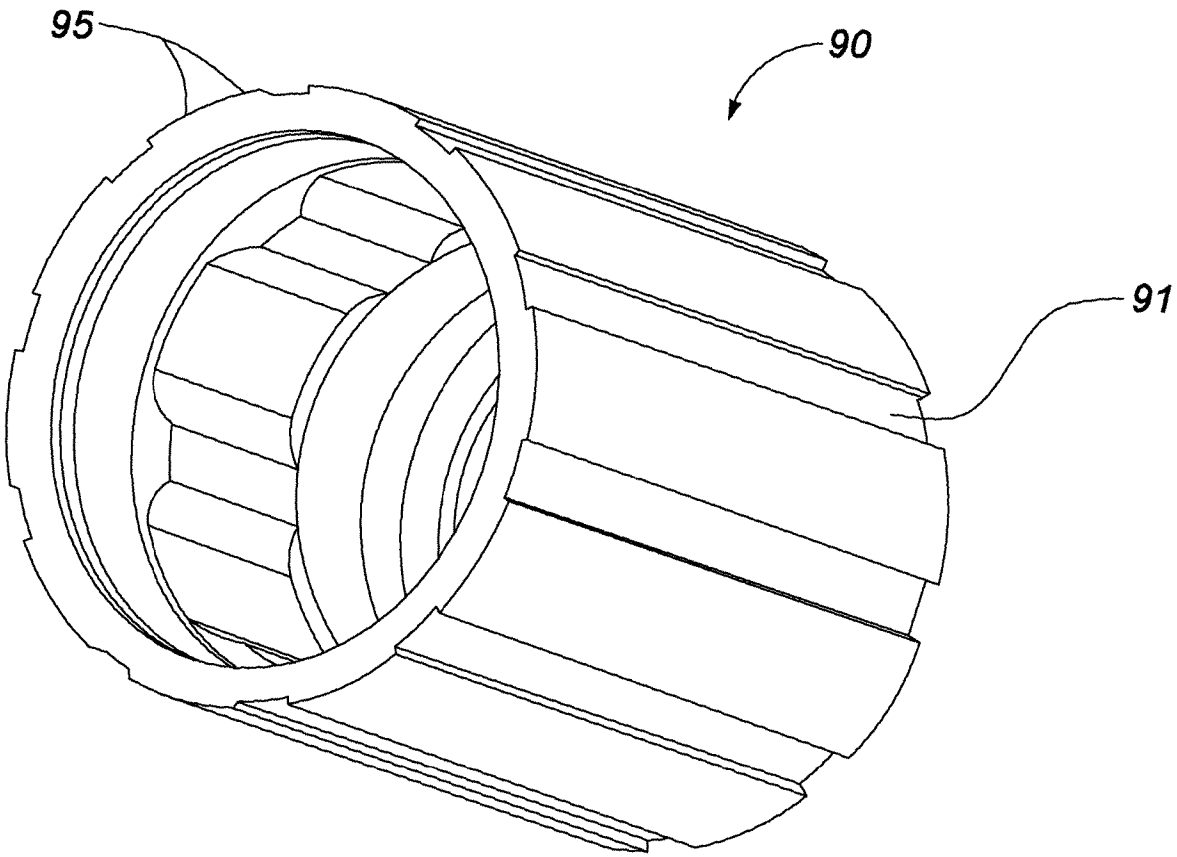
FIG. 20 is a detailed perspective view of the sheer retaining sleeve of the apparatus of FIG. 19.

Turning now to FIG. 19, an alternative embodiment of the present invention is illustrated in which bypass ports 170 are provided. Similar to the embodiment illustrated in FIGS. 17 and 18, after the frac is completed, the pressure may be reduced to draw a blocking body from a lower valve to the bottom surface of the split ring 60 whereafter the split ring and upper sleeve 40 are displaced towards the top cap 32. This retracted position will locate the split ring 60 over slots milled 95 into the inner surface of the shear retaining sleeve 90 as illustrated in FIG. 20. Thereafter fluids from the well are permitted to pass through the slots 95 and the bypass ports 170 to be recovered at the surface.

While specific embodiments of the invention have been described and illustrated, such embodiments should be considered illustrative of the invention only and not as limiting the invention as construed in accordance with the accompanying claims.

What is claimed is:

1. An apparatus for selectably isolating a subterranean formation from a production string, the apparatus comprising:

an elongate outer casing having an interior thereof extending therethrough, said outer casing having a plurality of apertures an exterior wall thereof;

an upper sleeve extending between first and second ends slidably located within said interior of said outer casing forming an annular void therebetween, said upper sleeve forming a central passage therethrough;

an annular piston slidably displaceable within said void between said outer casing and said upper sleeve so as to be positionable to selectably obstruct said plurality of apertures through said outer casing;

a lower sleeve located within said interior of said outer casing below said upper sleeve biased towards said upper sleeve, said lower sleeve forming a central passage therethrough in common with said upper sleeve;

an expandable ring located between said upper and lower sleeves;

a backing body located within said interior of said outer casing and having a retaining portion adapted to bias said expandable ring to radially extend inwardly into said central passage, said backing body having a recess therein adapted to permit said expandable ring to expand radially outward when displaced by a predetermined distance by a first spherical object upon said expandable ring, wherein said expandable ring selectably retains said spherical body thereon when biased inwardly by said retaining portion of said backing body so as to be operable to pressurize said central passage thereabove such that said pressure displaces said annular piston so as to uncover the apertures.

2. The apparatus of claim 1 wherein said backing body comprises a retaining sleeve surrounding said expandable ring.

3. The apparatus of claim 2 wherein said retaining sleeve is longitudinally slidably located within said void between said outer casing and said upper sleeve.

4. The apparatus of claim 3 wherein said retaining sleeve includes a recessed portion to receive said retaining ring thereinto when longitudinally displaced within said void.

5. The apparatus of claim 1 wherein said retaining portion comprises a retaining ring surrounding said expandable ring.

6. The apparatus of claim 1 wherein said upper sleeve is slidably located within said outer casing.

7. The apparatus of claim 6 wherein said expandable ring expands into a void above said retaining portion as said upper sleeve retracts towards a top end of said outer casing.

8. The apparatus of claim 1 further comprising an indexing assembly for permitting a predetermined number of spherical objects to pass thereby before retaining a next spherical object, the indexing assembly comprising:

a plurality of outer casing teeth inclined towards a bottom end of said outer casing extending radially outwardly from said lower sleeve into said void;

a plurality of lower sleeve teeth inclined towards a bottom end of said outer casing extending radially inwardly from said outer casing into said void;

first and second interlinked indexing rings located within said void between said outer casing and said lower sleeve, each of said first and second indexing ring having corresponding teeth with said outer casing teeth and said lower sleeve teeth so as to operable to be displaced by a predetermined distance when the sleeve is displaced from the first to the second position and remain at the predetermined distance when the sleeve returns to the first position.

9. The apparatus of claim 8 wherein said first and second indexing rings include corresponding teeth therebetween.

10. The apparatus of claim 8 wherein said first and second indexing rings include an annular wall extending from one of said first and second indexing rings into a longitudinally extending cavity formed in an other of said first and second indexing rings.

11. The apparatus of claim 1 further comprising an end stop within said void to prevent further longitudinal movement of said first and second indexing rings.

12. The apparatus of claim 11 wherein said end stop comprises a selectably longitudinally movable sleeve.

13. The apparatus of claim 12 wherein said end stop sleeve is released to be biased towards a first end of said outer casing after being depressed by said first and second indexing rings.

14. The apparatus of claim 13 further comprising a radially expandable ring adapted to expand into a void between said end stop sleeve and said outer casing after said longitudinal movement of said end stop sleeve.

15. A method for selectably isolating a subterranean formation from a production string, the method comprising:

engaging a blocking body upon a radially expandable ring within an outer casing;

applying a pressure to a top surface of said blocking body so as to bias said expandable ring and a lower sleeve towards a lower end of said outer casing;

permitting said expandable ring to expand into a recess in said outer casing to permit said blocking body to move therepast;

biasing said lower sleeve and said expandable ring back to an initial position;

after a predetermined quantity of blocking bodies have moved therepast, prevent said lower sleeve from further displacement to said recess; and applying an opening pressure to said top surface of said blocking body to pressurize an annular void between an upper sleeve and said outer casing to displace an annular piston located therebetween thereby uncovering ports extending through said outer casing.

16. The method of claim 15 wherein said determining a predetermined quantity of blocking bodies to move therepast comprises:

engaging a inner indexing ring upon inclined teeth extending from an outer surface of said lower sleeve;

engaging an outer indexing ring upon inclined teeth extending from an inner surface of said outer casing;

engaging said inner and outer indexing rings together to remain within a fixed range relative to each other, wherein said inclined teeth of said outer casing and said inner sleeve cooperate to permit said inner and outer indexing rings to move towards a bottom end thereof only to a fixed endwall whereafter further movement of the inner and outer indexing rings and lower sleeve is prevented.

* * * * *